United States Patent [19]

Swainson

[11] 4,008,930

[45] Feb. 22, 1977

[54] HUMIDOR

[75] Inventor: Ralph V. Swainson, Houston, Tex.

[73] Assignee: Texas Bryre Industries, Houston, Tex.

[22] Filed: Nov. 14, 1975

[21] Appl. No.: 631,886

[52] U.S. Cl. ..... 312/31.1; 21/77
[51] Int. Cl.[2] ..... A24F 25/02
[58] Field of Search ..... 312/31.1 T, 31.2; 21/77; 131/133 R, 140 R

[56] References Cited

UNITED STATES PATENTS

| | | | |
|---|---|---|---|
| 2,219,959 | 10/1940 | Laidley | 312/31.1 |
| 2,680,048 | 6/1954 | McDonald | 312/31.1 |
| 3,307,902 | 3/1967 | Nardi | 21/77 |

*Primary Examiner*—Casmir A. Nunberg
*Attorney, Agent, or Firm*—Fulbright & Jaworski

[57] ABSTRACT

There is disclosed a humidor having a body portion and a removable closure forming a substantially airtight compartment for holding tobacco or tobacco products, fruits, vegetables and the like. A reservoir is disposed at the upper portion of the compartment and the removable closure has a depressible portion for applying pressure to water in the reservoir. Water spray means are provided including a passage operable to spray the water in the reservoir into the compartment and thereby moisten the products upon depressing the depressible portion of the closure. Means are provided to introduce water into the reservoir and to permit air to flow into the reservoir after displacement of water therefrom.

Preferably, the closure is of the "snap-on" type and includes the reservoir, water spray including air introduction means and water introduction means into the reservoir, and the depressible portion is generally domeshaped. Further features are set forth below.

3 Claims, 2 Drawing Figures

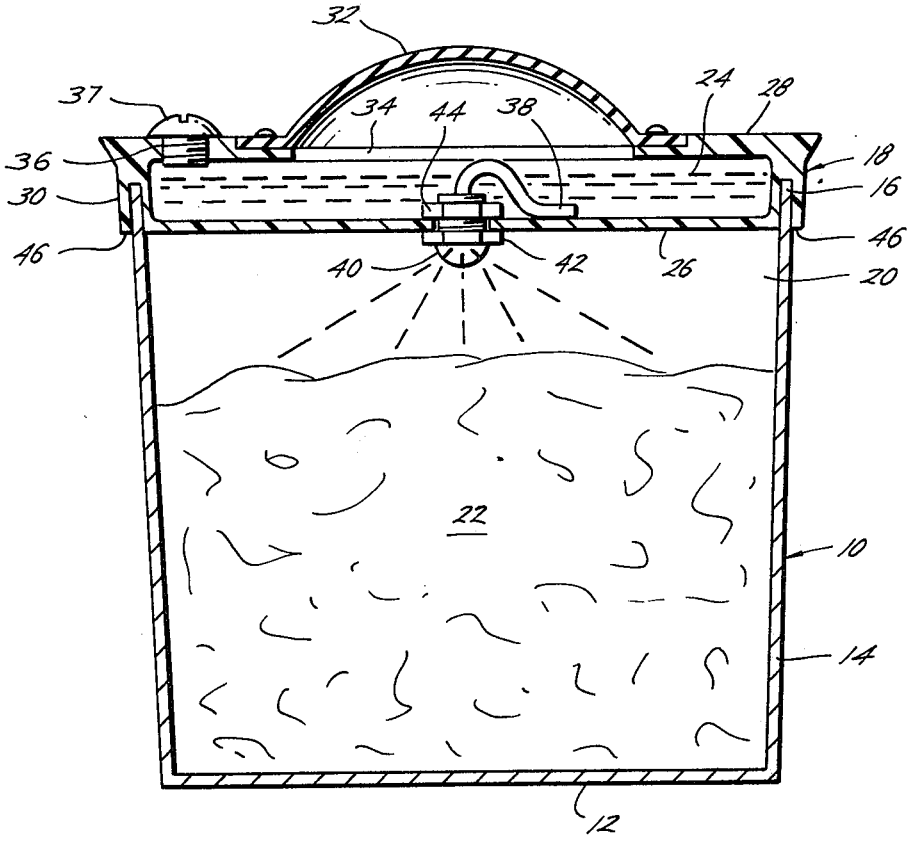
Fig. 1
Fig. 2
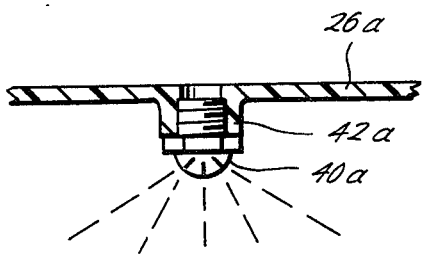

HUMIDOR

BACKGROUND OF THE INVENTION

In the past, pipe smokers have had a problem with smoking pipe tobacco due to the loss of water vapor from the tobacco. This is commonly thought of as stale or "old" tobacco. In reality, this tobacco is fresh but has been subjected to the loss of water vapor. Often this problem is accented by the fact that most buildings are air-conditioned.

In the past, most tobacco humidors have relied on supplying a source of water which was placed within an airtight container and allowed to slowly evaporate. Typical of these types of humidors are those which use water-adsorbant stones, sponges or plastic storage vessels. Patents disclosing humidors having means for moistening tobacco products and sprayers include U.S. Pat. Nos. 280,447; 1,298,415; 1,502,733; Re. 17,927 (of original 1,704,908); 2,460,554; and 3,336,093.

Also, the surfaces of fruits and vegetables in humidors become dry which results in discoloration of them unless rewetted from time to time.

It would be highly advantageous to provide a humidor having a self-contained reservoir and means for spraying water on the tobacco or tobacco products, fruits, vegetables, and the like in the humidors so that water can be readily sprayed on the surface of products in them and the amount of water sprayed can be regulated by the user to provide a desired surface moisture level. It would also be highly advantageous to provide a closure or cover for a humidor compartment which includes a water reservoir and means for spraying water to products in the humidor to the desired moisture level by simply exerting pressure on a depressible portion of the cover.

SUMMARY

The present invention is directed to a humidor having a water reservoir at its upper portion and spray means by which water can be readily sprayed on the tobacco or tobacco products, fruits, vegetables and the like, and the amount of water sprayed can be regulated by the user to a desired moisture level. The present invention is also directed to such a humidor and a removable closure or cover which is provided with a reservoir, a depressible portion for applying pressure to water in the reservoir, and water spray means including a passage from the water reservoir to the compartment operable to spray the water from the reservoir into the compartment upon depressing the depressible portion of the closure and to permit air to pass from the humidor into the reservoir after displacement of water therefrom. Preferably, the closure is of the "snap-on" type and includes a groove which fits about an upper edge of the humidor body in substantially airtight relationship.

Accordingly, it is an object of the invention to provide a humidor having a water reservoir at its upper portion and spray means for spraying water onto tobacco or tobacco products, fruits, vegetables and the like in the humidor in an amount as desired by the user.

A further object of the present invention is the provision of such a humidor which includes an airtight container with a snap-on closure or cover having a water reservoir and water spray means operable by a depressible portion of the cover to spray water onto products in the container.

A further object of the present invention is the provision of a humidor having means at its upper portion for spraying moisture on products in the humidor in an amount as desired by the user and which is economical and inexpensive to manufacture.

A still further object of the present invention is the provision of a cover for a humidor which includes a water reservoir and water spray means for spraying water from the reservoir onto products in a humidor when attached thereto.

Other and further objects, features and advantages will be apparent from the Abstract of the Disclosure, the Background of the Invention, this Summary, the drawings, the Description of the Preferred Embodiments and the Claims.

BRIEF DESCRIPTION OF THE DRAWINGS

Fig. 1 is an elevational view in section of a humidor and closure or cover according to the invention, and Fig. 2 is a fragmentary view illustrating a modified form of spray means for spraying moisture onto tobacco or tobacco products in the humidor.

DESCRIPTION OF THE PREFERRED EMBODIMENTS

While the embodiments of the humidor illustrated in the drawing and described in detail herein are directed to use for tobacco and tobacco products it will be understood that the humidor may be used for all products, such as fruits, vegetables and the like, in which it is desirable to spray their surfaces with water. The humidors may be separate or form a part of other articles of manufacture, such as refrigerators. Also, the humidors will be of a size and configuration desired for the particular end use to which the humidor is to be put.

Referring now to the drawing, the reference numeral 10 designates an embodiment of a humidor according to the present invention, and includes the bottom 12 and upwardly extending sidewall 14 terminating in an upward edge 16 and being closed by the removable closure or cover 18 to form the substantially airtight compartment 20 for the reception of tobacco or tobacco products 22. The body may take any desired shape; however, in the embodiment illustrated the body is circular in cross-section, in which event the upwardly extending edge 16 is also circular in configuration.

A reservoir 24 is provided at the upper portion of the humidor 10 and, preferably, is disposed in the cover 18 and is formed by the bottom 26, the top 28, and the sidewall 30.

The closure or cover 18 includes the depressible portion 32 which is secured to the top 28, although it may be integrally formed therewith, which depressible portion 32 generally covers and is coextensive with the cutout portion 34 in the top 28, so that by depressing the depressible portion 32, pressure is applied to water in the reservoir 24 so that it is sprayed onto the tobacco or tobacco products 22 in the compartment 20 as later described.

Means are provided for inflow of water into the reservoir 24 and this includes a filler opening 36 which may be closed by the filler plug 37 so that water can be added to the reservoir as needed.

Water spray means are provided in the bottom 26 of the closure or cover 18 and includes a passage through the spray tube or hose 38 extending to the spray nozzle 40, which is secured by the threaded bolts 42 and 44 to the bottom 26 of the closure 18.

The closure or cover 18 is secured to the sidewall 14 of the humidor preferably in substantially airtight relationship and, preferably, by means of the groove 46 extending downwardly in the sidewall 30 of the cover 18 which groove 46 snugly fits about the upper edge of the sidewall 14.

The shape of the cover 24 and the groove 46 is such as to accommodate the shape of the humidor sidewall 14 and, in the embodiment illustrated, the groove 46 is circular.

Preferably, the closure or cover 18 is of the "snap-on" type, and is made of a material which is sufficiently resilient to snap onto the wall 14. The cover 18 may be any of the various plastic or rubber-like materials readily available on the market, and no detailed description thereof is deemed necessary or given.

The humidor body may be made of any desired material, and the cover or closure 18 is removable secured to the humidor body in any desired manner. Also, the reservoir 24, means for inflow of water may all be provided as a removable upper portion of the humidor rather than in the cover; however, it is an important aspect of the present invention to provide a removable cover having the water reservoir, spray means and water inflow means so that no modifications have to be made to the humidor body in making and using a humidor according to the invention.

Referring now to FIG. 2, a variation in the attachment of the spray nozzle is illustrated in which the reference letter *a* has been added to numerals designating corresponding parts in FIG. 1. Thus, in FIG. 2, the spray nozzle 40*a* is secured to the bottom wall 26*a* by threading into the depending box 42*a*. All other parts and mode of operation are the same as that of the embodiment illustrated in FIG. 1.

In use, tobacco or tobacco products, such as cigarettes, cigars and the like, are placed in the compartment 20, the removable closure or cover 18 snapped onto the upper edge 16 of the sidewall 14, the filler plug 37 removed and water poured into the reservoir 24 and the filler plug 37 replaced. By depressing the dome-like depressible portion 32, pressure is applied to the upper surface of the water in the reservoir 24 which forces water through the water spray means including the passage in the tube 38 through the spray head 40. As the depressible portion 32 rises, air is sucked into the reservoir 24 through the spray head 40 from the compartment 20. The shape of the tube 38 is such that water will not flow into the compartment 20 from the reservoir 24 without applying pressure to the surface of the water. If desired, the tube 38 can be omitted and a suitable valve used in its place which functions to permit water to be sprayed as previously mentioned. The user can add as much or as little water as desired to the products and then the humidor 10 can be gently shaken, if desired, so that all of the tobacco or tobacco products are moisturized in an amount desired.

When it is desired to use the tobacco or tobacco products, the cover 18 is readily removed, the tobacco or tobacco products desired obtained from the humidor compartment 20 and the cover 18 is then snapped back into place.

As previously mentioned, any desired means may be utilized to spray water from the reservoir 24 into the compartment 20 and onto the tobacco or tobacco products 22, any type of filler arrangement for water in the reservoir 24 can be utilized, all of which are readily available and, accordingly, no detailed description thereof is given or deemed necessary.

As previously mentioned, the humidor can be used for products other than tobacco or tobacco products, such as for fruits, vegetables, etc. and can form a part of other articles of manufacture, such as refrigerators, ice chests, etc. and can be of any desired shape and size.

It is thus apparent that a humidor and its cover constructed according to the invention attains all the objects and ends and has the advantages and features mentioned as well as others inherent therein.

While presently-preferred embodiments of the invention have been given for the purposes of disclosure, changes may be made therein which are within the spirit of the invention as defined by the scope of the appended claims.

What is claimed is:

1. A humidor comprising, a body having bottom and side walls forming a storage compartment, a cover, means for removably securing the cover to the body to close the storage compartment, the cover including bottom, side and top walls forming a liquid reservoir, a domed-shaped depressible portion forming a portion of the top wall operable to apply pressure to liquid in the liquid reservoir, the cover including a closable filler opening for flow of liquid into the liquid reservoir, and liquid spray means operable to spray liquid into the storage compartment from the reservoir in response to pressure applied to the liquid by depressing the dome-shaped depressible portion, including a passage extending through the bottom of the cover and a spray nozzle communicating with the passage connected to the bottom and arranged to direct the spray of liquid downwardly into the storage compartment.

2. The humidor of claim 1, where, the side walls terminate in an upwardly extending flange, and, the removable closure is provided with a groove fitting about the flange in substantially airtight relationship.

3. A cover for a humidor comprising, bottom, side and top walls forming a liquid reservoir, a dome-shaped depressible portion forming a portion of the top wall operable to apply pressure to liquid in the liquid reservoir, liquid spray means operable to spray liquid into the storage compartment from the reservoir in response to pressure applied to the liquid by depressing the dome-shaped depressible portion, a passage extending through the bottom of the cover and a spray nozzle communicating with the passage connected to the bottom and arranged to direct the spray of liquid downwardly into a storage compartment of the humidor, and means for removably securing the cover to the top of the humidor.

* * * * *